US009222758B2

(12) United States Patent
Strum

(10) Patent No.: US 9,222,758 B2
(45) Date of Patent: Dec. 29, 2015

(54) VERSATILE PROTECTIVE HELMET APPLIQUÉ ASSEMBLY

(75) Inventor: David B. Strum, Amissville, VA (US)

(73) Assignee: Velocity Systems, LLC, Dulles, VA (US)

( * ) Notice: Subject to any disclaimer, the term of this patent is extended or adjusted under 35 U.S.C. 154(b) by 267 days.

(21) Appl. No.: 13/594,964

(22) Filed: Aug. 27, 2012

(65) Prior Publication Data

US 2013/0047309 A1 Feb. 28, 2013

Related U.S. Application Data

(60) Provisional application No. 61/527,671, filed on Aug. 26, 2011.

(51) Int. Cl.
*F41H 1/04* (2006.01)
*A42B 3/00* (2006.01)

(52) U.S. Cl.
CPC .. *F41H 1/04* (2013.01); *A42B 3/003* (2013.01)

(58) Field of Classification Search
CPC ..... F41H 1/04
USPC ..... 2/2.5, 411, 425, 410, 6.6, 6.1, 422
See application file for complete search history.

(56) References Cited

U.S. PATENT DOCUMENTS

| | | | | |
|---|---|---|---|---|
| 3,582,990 | A | 6/1971 | Frieder et al. | |
| 4,023,209 | A * | 5/1977 | Frieder et al. | 2/6.6 |
| 4,908,877 | A | 3/1990 | White | |
| 4,996,724 | A | 3/1991 | Dextrase | |
| 5,056,162 | A | 10/1991 | Tirums | |
| 5,309,576 | A | 5/1994 | Broersma | |
| 6,026,510 | A * | 2/2000 | Kocher | 2/2.5 |
| 6,243,881 | B1 | 6/2001 | Brinkman | |
| 6,272,692 | B1 | 8/2001 | Abraham | |
| 6,324,700 | B1 | 12/2001 | McDougall | |
| 6,363,539 | B2 | 4/2002 | Tachi et al. | |
| 6,804,829 | B2 | 10/2004 | Crye et al. | |
| 7,805,776 | B2 | 10/2010 | Crossman et al. | |
| 8,020,220 | B2 | 9/2011 | McElroy et al. | |
| 8,166,573 | B1 * | 5/2012 | Chung et al. | 2/411 |
| 8,613,114 | B1 | 12/2013 | Olivares Velasco | |
| 8,776,272 | B1 * | 7/2014 | Straus et al. | 2/411 |
| 2001/0004773 | A1 | 6/2001 | Moore | |

(Continued)

FOREIGN PATENT DOCUMENTS

| | | |
|---|---|---|
| DE | 100 28 849 | 12/2001 |
| JP | 2002294512 | 10/2002 |

OTHER PUBLICATIONS

Office Action for U.S. Appl. No. 13/912,720, Oct. 16, 2015.

*Primary Examiner* — Anna Kinsaul
(74) *Attorney, Agent, or Firm* — Williams Mullen, PC; Thomas F. Bergert

(57) ABSTRACT

The helmet appliqué assembly of the present invention permits a helmet wearer to upgrade the ballistic prevention capabilities of a traditional helmet quickly and efficiently. The helmet appliqué can be provided as part of a helmet appliqué system and/or assembly that includes an internal-side connection for attaching to a helmet and an external-side connection for receiving any of various external items such as identification tags, mounts and external equipment or attachments. The appliqué element can comprise various types of material, including, for example, ultra high molecular weight polyethylene (UHMWPE).

8 Claims, 3 Drawing Sheets

(56) References Cited

U.S. PATENT DOCUMENTS

| | | | | |
|---|---|---|---|---|
| 2004/0060100 | A1 | 4/2004 | Reiterman | |
| 2006/0248623 | A1* | 11/2006 | Miller | 2/6.6 |
| 2007/0130672 | A1 | 6/2007 | Beddoe | |
| 2007/0157370 | A1 | 7/2007 | Joubert Des Ouches | |
| 2009/0313736 | A1 | 12/2009 | Kocher et al. | |
| 2010/0275337 | A1 | 11/2010 | Bhatnagar et al. | |
| 2011/0055993 | A1 | 3/2011 | Baudou et al. | |
| 2011/0083240 | A1 | 4/2011 | Crye et al. | |
| 2011/0099675 | A1 | 5/2011 | Parks et al. | |
| 2011/0203024 | A1 | 8/2011 | Morgan | |
| 2011/0205731 | A1 | 8/2011 | O'Keefe et al. | |
| 2012/0011631 | A1* | 1/2012 | Crossman et al. | 2/2.5 |

* cited by examiner

VERSATILE PROTECTIVE HELMET APPLIQUÉ ASSEMBLY

CROSS-REFERENCE TO RELATED APPLICATIONS

The present application claims priority to U.S. Provisional Patent Application 61/527,671, filed Aug. 26, 2011 and entitled "Protective Helmet Appliqué System and Method."

FIELD OF THE INVENTION

The present invention pertains to armor-enhanced headwear, and more particularly to an armor-enhanced helmet appliqué assembly including a helmet appliqué that is comfortable, balanced, detachable, versatile and which protects the head from projectiles such as ballistic projections.

BACKGROUND AND SUMMARY OF THE INVENTION

Military and law enforcement personnel have employed armor-enhanced clothing in order to protect their bodies from gunfire, shrapnel, explosive devices and other harmful ballistic objects. Such personnel have further employed armor-enhanced helmets in an effort to block ballistic objects from penetrating traditional helmets and producing injury or grave damage to the head of the wearer. However, prior armor-enhanced helmets are typically heavy and awkward to wear, often causing undue neck fatigue and even injury to the wearer.

The present invention provides a helmet appliqué assembly including a helmet appliqué that is lighter weight, and attachable to an existing helmet to cover one or more areas of an otherwise exposed helmet. The appliqué element of the present invention can be suitably relieved in areas where no ballistic protection is required, or where ballistic protection would otherwise impede certain functions of the helmet and the wearer's desired functional capabilities. The appliqué element of the present invention can comprise various types of material, including, for example, ultra high molecular weight polyethylene (UHMWPE), aramid fibers, ceramics, polycarbonate, steel or a combination of two or more such materials. The appliqué assembly of the present invention further includes one or more underside attachment member types for attaching the appliqué to a helmet, and can optionally include one or more external-side attachment or connector members for attaching other articles to the outside of the appliqué element. Accordingly, the appliqué system and/or assembly of the present invention increases the protection level of a helmet in a specific area or areas as a mission or threat dictates by allowing the appliqué element to be donned or doffed as needed, and thereby does not require the additional weight of the appliqué element to be permanent.

DETAILED DESCRIPTION OF EMBODIMENTS OF THE PRESENT INVENTION

Figure 1:
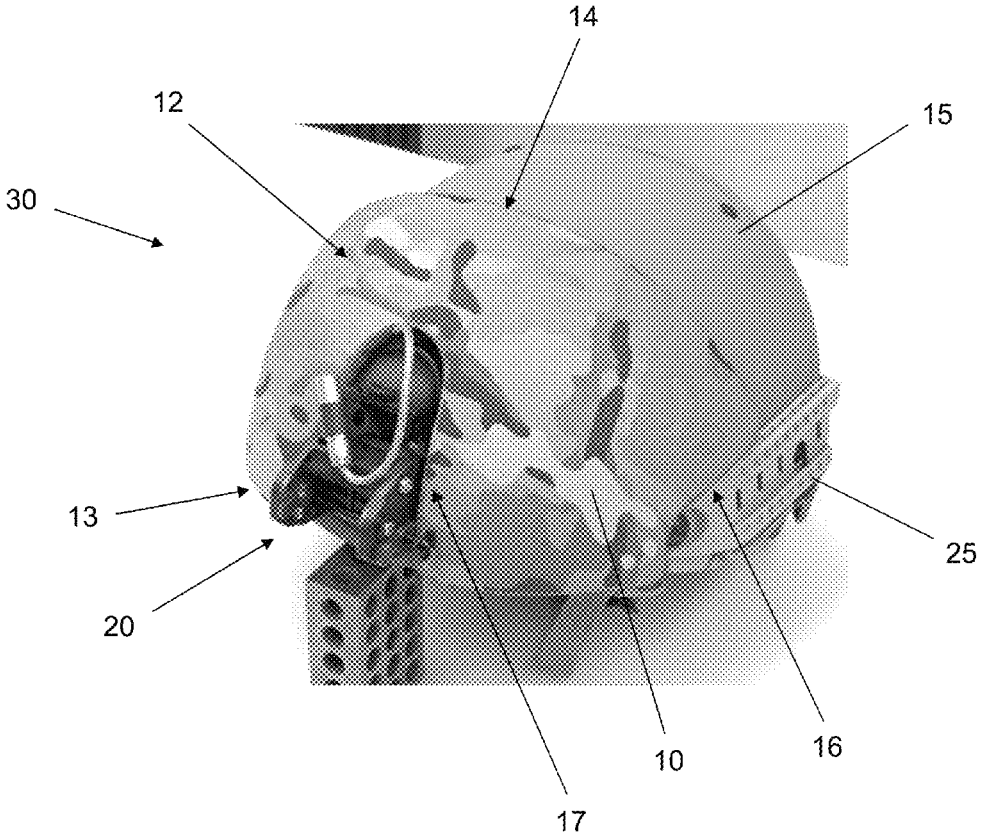
FIG. 1 is a top right perspective view of one embodiment of the appliqué assembly of the present invention in position on a helmet.

As shown in FIG. 1, one embodiment of the helmet appliqué assembly 30 of the present invention includes a helmet appliqué element 10 attached to an underlying helmet 15. The helmet 15 can be provided with various attachments such as a night vision device mount 20 and a rail system 25. The rail system permits the helmet to attach necessary or desirable articles such as lighting, camera or other accessories as is known in the art. The appliqué element 10 is formed and shaped so as to avoid impeding the use and functionality of the night vision device mount 20 and rail system 25, and can further be designed in alternative embodiments to extend further or less in a given direction depending upon the specific underlying helmet involved.

In the embodiment shown in FIG. 1, the ballistic appliqué element 10 of the present invention includes an external surface 12 and an internal surface in between the element 10 and the helmet 15, a front profile edge 13, a rear profile edge 14 and two side profile edges 16, wherein the side profile edges are curved so as to provide relief around edge attachments 25 of the helmet. The front profile edge 13 can be formed so as to provide an opening 17 in a variety of shapes, such as rectangular, square and/or shaped. In the embodiment shown in FIG. 1, the front profile edge 13 is formed so as to provide a substantially U-shaped opening 17 in the appliqué element. The appliqué element 10 can comprise ballistic material hermetically sealed and encapsulated within a fabric material, wherein the ballistic material comprises one or more of: ultra-high molecular weight polyethylene, aramid fibers, ceramics, polycarbonate material, and/or steel as described above.

In one embodiment of the present invention, the helmet appliqué assembly 30 further includes one or more connector members secured to the internal surface of the appliqué element 10, with the connector members being capable of secure engagement with one or more counterpart connector members of the helmet 15. For instance, hook-and-loop type fasteners, straps, snaps and other similar attachment means can be employed. It will be appreciated that the fastener elements can be directly secured to the fabric material described above.

Figure 2:
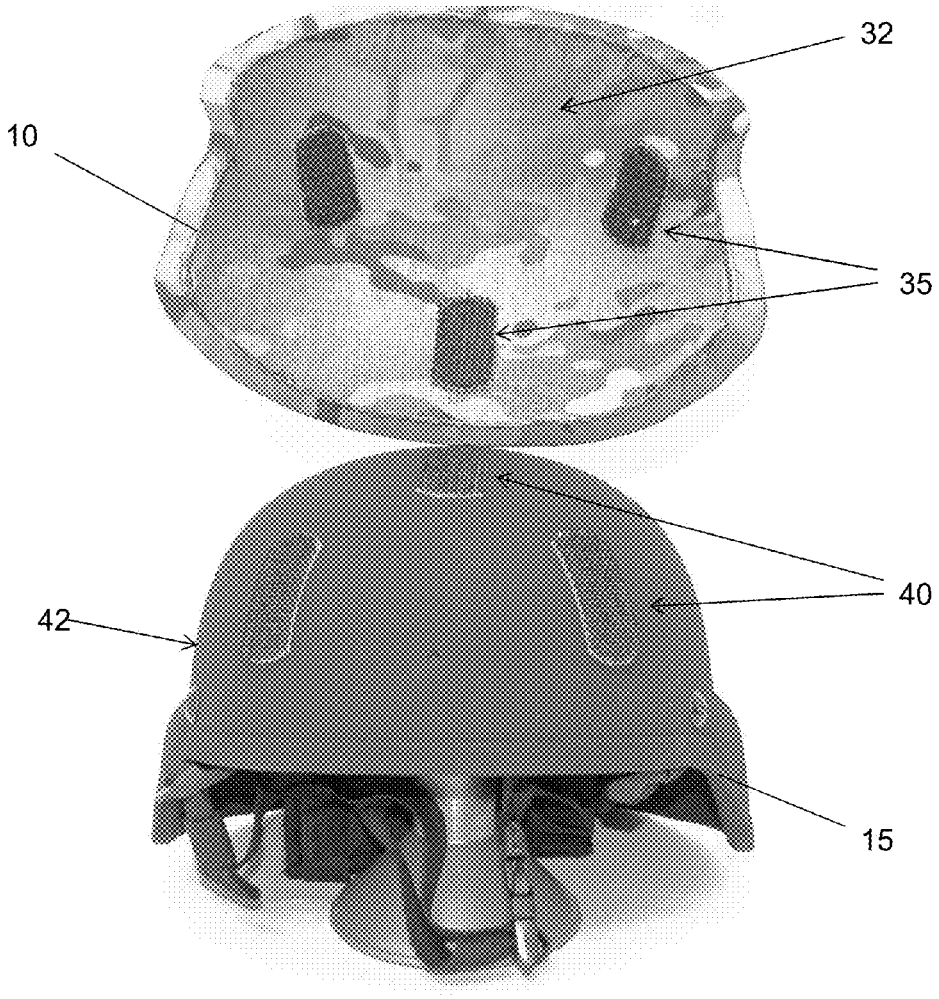
FIGS. 2 and 3 are front views of photographs of the appliqué assembly of the present invention as removed from a secured position on a helmet.
Figure 3:
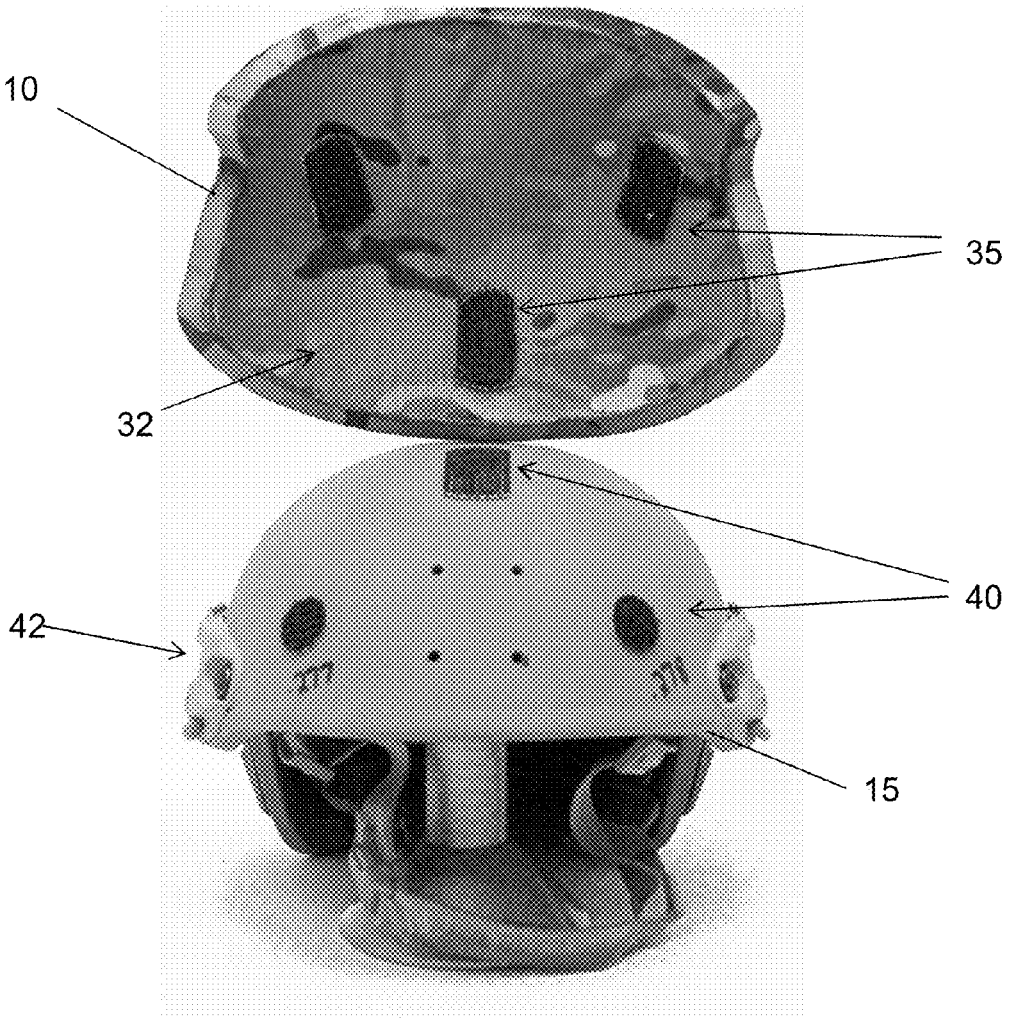

In a specific embodiment, a hook or loop fastener strip, with adhesive on one side and hook or loop fasteners on the other, is adhered to the internal surface of the appliqué element 10, such that the adhesive side is pressed against the internal surface of the appliqué element and the hook or loop side faces outwardly. A counterpart loop or hook strip can be similarly applied to an underlying helmet (such as helmet 15) in order to be able to securely retain the strip affixed to the internal surface of the appliqué element. It will be appreciated that multiple hook or loop strips can be secured to the internal surface of the appliqué element in locations deemed most suitable to create a secure but releasable fit with the underlying helmet. Such an arrangement is illustrated in the embodiments of the present invention shown in FIGS. 2 and 3, wherein the helmet appliqué element 10 includes fasteners 35 secured to the internal surface 32 thereof, and these fasteners 35 are aligned so as to mate with counter fastener elements 40 on the exterior surface 42 of helmet 15. When element 10 is desired to be donned, it can be attached to helmet 15 by aligning fasteners 35 with fasteners 40, and when element 10 is desired to be doffed, it can be lifted with sufficient pressure from helmet 15 in order to overcome the retention strength of the fasteners, thereby allowing element 10 to be removed.

As an alternative to hook or loop strips, the present invention can use other connector member types, such as male or female snap members secured to the internal surface of the appliqué element, and positioned so as to mate with the counterpart female or male snap members on the outer surface of the helmet. As a further alternative, the connector member types can comprise one or more straps that can be secured to the underlying helmet in known fashion.

In the embodiment of the present invention as shown in FIG. 1, the helmet appliqué element 10 is applied to the frontal lobe of the helmet. However, it will be appreciated that the helmet appliqué element 10 can cover different or additional areas of the helmet depending upon intended use and anticipated threat or mission. Further, it will be appreciated that multiple helmet appliqué elements can be employed on the same helmet when desirable.

In one embodiment of the present invention, one or more connector members on the internal side of the appliqué element 10 are evenly distributed across the helmet appliqué so as to mate with appropriate mating attachment elements distributed across the helmet. In another embodiment of the present invention, the helmet appliqué element is provided as part of a helmet appliqué system kit or assembly, wherein the kit includes alternative attachment members for selection and use by the wearer or assembly personnel. Such an assembly can further include elements that can readily be secured to a helmet that may otherwise be incapable of receiving the helmet appliqué element of the present invention. For example, the kit can include, strips of loop-type fasteners with an adhesive substance on one side and loop fasteners on the other, such that the adhesive side can be secured to the helmet, leaving the loop fasteners exposed and available for receiving mating hook fasteners secured to the underside of the helmet appliqué element. Similarly, such an assembly or kit can include one or more attachment components for attaching external elements to the external side of the appliqué element 10. For instance, a loop-type fastener strip with adhesive on one side can be secured to an identification tag via the adhesive side, and the loop-type fastener side can then be exposed for securing to a hook-type fastener on the external side of the appliqué element 10.

The appliqué element of the present invention can be quickly donned and doffed through the use of the attachment components of the present invention. When not in position on a helmet, one embodiment of the appliqué element 10 of the present invention is semi-rigid and can be stored in standalone or stacked fashion.

The present invention thus provides a helmet appliqué assembly including a helmet appliqué element that is lighter weight, and attachable to an existing helmet to cover one or more areas of an otherwise exposed helmet. As described above, the present invention can be suitably relieved in areas where no ballistic protection is required, or where ballistic protection would otherwise impede certain functions of the helmet and the wearer's desired functional capabilities. The appliqué element of the present invention can comprise various types of ballistic material, including, for example, ultra high molecular weight polyethylene (UHMWPE), aramid fibers, ceramics, polycarbonate, or a combination of two or more such materials, In one embodiment of the present invention, the appliqué element can be provided in form similar to a "soft armor" product, wherein the ballistic material is hermetically RF heat sealed and encapsulated within a fabric material (e.g., Cordura™) in order to maintain ballistic integrity in wet or sandy environments.

The invention may be embodied in other specific forms without departing from the spirit or essential characteristics thereof. The present embodiments are therefore to be considered in all respects as illustrative and not restrictive, the scope of the invention being indicated by the claims of the application rather than by the foregoing description, and all changes which come within the meaning and range of equivalency of the claims are therefore intended to be embraced therein.

The invention claimed is:

1. A helmet applique assembly for attachment to a helmet, comprising: a ballistic applique element having an external surface, an internal surface, a front profile edge, a rear profile edge and two side profile edges, wherein the front profile edge is formed with a substantially U-shaped opening so as to avoid impeding the use of a helmet attachment, wherein the applique element is semi-rigid and includes ballistic material hermetically sealed and encapsulated within a fabric material; and one or more connector members secured to the internal surface of the applique element and capable of secure engagement with one or more counterpart connector members of the helmet.

2. The assembly of claim 1, wherein the applique comprises at least one of: ultra-high molecular weight polyethylene (UHMWPE), aramid fibers, ceramics, and polycarbonate material.

3. The assembly of claim 1, wherein the appliqué element further includes one or more connector members secured to the external surface for attaching articles to the appliqué.

4. The assembly of claim 1, wherein the side profile edges are curved so as to provide relief around edge attachments of the helmet.

5. The assembly of claim 1, wherein the applique element is attachable to different locations of the helmet via hook and loop fasteners.

6. A helmet appliqué assembly, comprising:

a ballistic appliqué element having an external surface, an internal surface, a front profile edge, a rear profile edge and two side profile edges, wherein the front profile edge is formed with a substantially U-shaped opening so as to avoid impeding the use of a helmet attachment, wherein the appliqué element is semi-rigid and includes ballistic material hermetically sealed and encapsulated within a fabric material;

a plurality of internal connector member types adapted to be secured to the internal surface of the appliqué element and capable of secure engagement with one or more counterpart connector members of a helmet; and at least one external connector member type adapted to be secured to the external surface of the appliqué element.

7. The assembly of claim 6 wherein the plurality of internal connector member types include one or more strips having an adhesive on one side and hook or loop fasteners on the other side, one or more male or female snap elements, and one or more straps.

8. A helmet applique assembly for attachment to a helmet, comprising: a ballistic applique element having an external surface and an internal surface, a front profile edge, a rear profile edge and two side profile edges, wherein the side profile edges are curved so as to provide relief around edge attachments of the helmet, and wherein the front profile edge is formed with a substantially U-shaped opening so as to avoid impeding the use of a helmet attachment, wherein the applique element further comprises ballistic material hermetically sealed and encapsulated within a fabric material, and wherein the ballistic material comprises one of: ultra-high molecular weight polyethylene, aramid fibers, ceramics, and polycarbonate material; and one or more connector members secured to the internal surface of the applique element and capable of secure engagement with one or more counterpart connector members of the helmet.

* * * * *